US005507168A

United States Patent [19]

Mizukawa et al.

[11] Patent Number: 5,507,168

[45] Date of Patent: Apr. 16, 1996

[54] APPARATUS FOR BENDING A STRIP MATERIAL

[76] Inventors: Suehiro Mizukawa, 4-25, Torikainishi 5-chome, Settsu-shi, Osaka 566; Susumu Ohtani, 7-11, Takawashi 3-chome, Habikino-shi, Osaka 583; Naoki Ogawa, 4792-54, Najio, Shiozecho, Nishinomiya-shi, Hyogo 669-11, all of Japan

[21] Appl. No.: 211,557

[22] PCT Filed: Jun. 17, 1993

[86] PCT No.: PCT/JP93/00818

§ 371 Date: Apr. 8, 1994

§ 102(e) Date: Apr. 8, 1994

[87] PCT Pub. No.: WO95/00266

PCT Pub. Date: Jan. 5, 1995

[51] Int. Cl.[6] ..... B21D 7/02

[52] U.S. Cl. ..... 72/387; 72/307

[58] Field of Search ..... 72/307, 319, 320, 72/321, 386, 387

[56] References Cited

U.S. PATENT DOCUMENTS

| | | | |
|---|---|---|---|
| 757,078 | 4/1904 | Wood | 72/387 |
| 5,203,195 | 4/1993 | Ritter et al. | 72/387 |

FOREIGN PATENT DOCUMENTS

| | | | |
|---|---|---|---|
| 15354 | 9/1980 | European Pat. Off. | 72/387 |
| 2215490 | 10/1973 | Germany | 72/387 |
| 63-309328 | 12/1988 | Japan . | |
| 0258818 | 10/1989 | Japan | 72/387 |
| 8809703 | 12/1988 | WIPO | 72/307 |

*Primary Examiner*—David Jones
*Attorney, Agent, or Firm*—Jones, Tullar & Cooper

[57] ABSTRACT

The present invention relates to an apparatus for bending a strip material such as a band blade. A stationary die having a slit through which the strip material is passed is integrated with a shaft body. A movable die which cooperates with the stationary die to bend the strip material is formed into a cylindrical shape. The rotation is transmitted from an electric motor, only to one end of the movable die. The replacement of the stationary die is facilitated by attaching the lower end of the shaft body by mounting bolts to a machine base through a mounting member. When the stationary die is to be replaced, the mounting bolts are removed, the shaft body and the mounting member are pulled out to the lower side of the machine base, and another shaft body is inserted from the lower side of the machine base, and the mounting member is fixed to the machine base by using the mounting bolts.

8 Claims, 8 Drawing Sheets

APPARATUS FOR BENDING A STRIP MATERIAL

TECHNICAL FIELD

The present invention relates to an apparatus for bending a strip material such as a steel strip, and, in particular to an apparatus for bending a strip material such as a band blade for a Thomson blade wooden model.

BACKGROUND ART

An apparatus for bending a strip material, is known wherein a stationary die having a slit through which the strip material is passed is provided, and the strip material projecting from the slit is pressed by a movable die against an outlet corner of the slit, so that the strip material is bent in one direction by a fixed angle.

SUMMARY OF THE INVENTION

It is an object of the present invention to provide an apparatus for bending a strip material in which a movable die having a novel configuration is adopted so that, even when a rotation transmission mechanism is connected only to one end in the axial direction of the movable die, the parallelism of a pair of opposing pressing die portions of the movable die is not impaired during a bending process, and the rotation transmission mechanism is connected only to one end in the axial direction of the movable die so that the user can easily replace only a shaft body integrally comprising a stationary die, without disassembling gears of the rotation transmission mechanism, and the movable die.

To achieve the above-mentioned object, the apparatus for bending a strip material according to the present invention is an apparatus for bending a strip material which comprises a stationary die having a slit through which a strip material is passed, and a movable die which is moved by a predetermined amount when feeding of the strip material passed through the slit is halted, and in which the strip material passed through the slit is pressed by the movable die against an outlet corner of the slit, whereby the strip material is bent the through a fixed angle, wherein the stationary die is integrated with a middle portion in the axial direction of a shaft body, the lower end of the shaft body is fixed by mounting bolts to a machine base through a mounting member, the movable die comprises at a predetermined position along the circumferential direction a pair of pressing die portions which oppose each other in the circumferential direction, and is formed into a cylindrical shape having an opening for introducing the strip material at a position opposite to the pressing die portions, the cylindrical movable die is rotatably fitted outward onto the shaft body with correspondence to the stationary die, and a rotation transmission mechanism for transmitting a rotation force to the movable die is connected to one end in the axial direction of the movable die.

According to this configuration, since the movable die comprising the pair of pressing die portions is formed into a cylindrical shape, the parallelism of the pair of pressing die portions is free from being impaired. The movable die is connected only at its one end with the rotation transmission mechanism. When the stationary die, or the shaft body comprising the stationary die is to be removed, therefore, the mounting bolts by which the mounting member is attached to the machine base are removed, and the shaft body and the mounting member can be removed. When there arises the necessity of removing the shaft body, it is not required to remove the gears of the rotation transmission mechanism or remove the movable die before the removal of the shaft body, and it is possible to remove only the shaft body so that the stationary die provided for the shaft body can be replaced. Even after the replacement of the stationary die, it is not necessary to adjust the parallelism of the pressing die portions.

In the bending apparatus, a downward taper portion disposed at the lower end of the shaft body is fitted into a mounting hole which is opened in the mounting member and which has an upward spread shape, and a key is fittingly attached to key ways which are respectively formed in the downward taper portion and the mounting hole, whereby the positional relationship between the slit of the stationary die provided for the shaft body, and the pressing die portions of the movable die can be set easily and accurately.

Furthermore, a spacer is superposed on the lower face of the mounting member, and a clamping bolt is screwed through a hole of the spacer into a tapped hole formed in the lower end of the shaft body, whereby the downward taper portion of the shaft body is clamped and fixed to the upward spread shaped mounting hole of the mounting member. Therefore, the shaft body is firmly fixed to the mounting member.

Other various features of the present invention will be apparent from the following description.

DETAILED DESCRIPTION

A bending apparatus in which a movable die is moved along an arcuate path so that a strip material can be bent by an angle greater than a right angle by one pressing operation of the movable die, and the strip material can be bent in either of the rightward and leftward directions has been developed.

Figure 8:
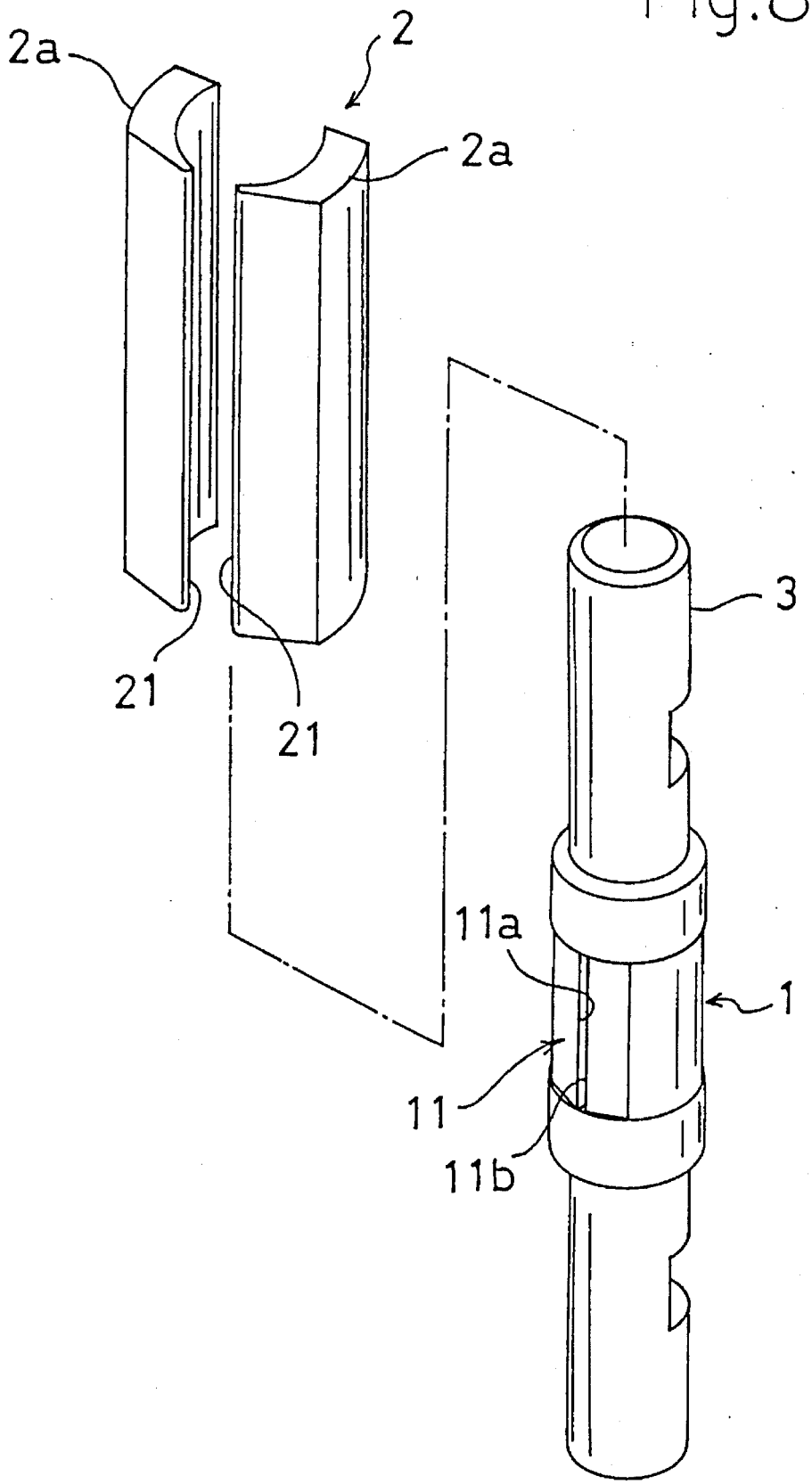
FIG. 8 is an exploded perspective view showing a shaft body comprising a stationary die, and a movable die which are used in a bending apparatus that is a comparison example.

FIG. 8 shows a stationary die and a movable die which are used in the bending apparatus of the prevent invention. In the figure, the stationary die is designated by reference numeral 1 and the movable die by reference numeral 2. The stationary die 1 is integrated with a middle portion in the axial direction of a shaft body 3, and comprises a slit 11 through which a strip material (not shown) is to be passed. The movable die 2 consists of a pair of arcuate members **2*a*, 2*a* having pressing die portions 21, 21. The arcuate members 2*a*, 2*a* are disposed at both sides of the stationary die 1 so as to sandwich it. During the process of bending the strip material, the movable die 2 consisting of the pair of arcuate members 2***a*, 2*a* is rotated about the shaft body 3 in the forward or reverse direction through a predetermined angle, and the strip material extending out or projecting from the slit 11 of the stationary die 1 is pressed against an outlet corner 11*a* or 11*b* of the slit 11 by one of the pressing die portions 21 of the movable die 2, whereby the strip material is bent by a fixed angle in a predetermined direction.

In such a bending apparatus, from the view point of improving working accuracy, it is indispensable to set the parallelism of the pressing die portions 21, 21 of the pair of arcuate members 2*a*, 2*a* constituting the movable die 2, to be highly accurate. Furthermore, there is a fact that, in the case where a strip material, particularly a band blade or the like noted above, is to be bent, an extremely large force is required for the bending when the band blade has a rather large thickness. Even when such a large bending force is required, the movable die 2 comprised by the pair of arcuate members 2*a*, 2*a* must be able to be rotated over a predetermined angle without being twisted or impairing the parallelism of the pressing die portions 21, 21.

To comply with this requirement, the bending apparatus according to the present invention is configured in the following manner: The pair of arcuate members 2*a*, 2*a* are fixed by a rigid body (not shown) so as not to change their relative positions, thereby maintaining the parallelism of the pressing die portions 21, 21 at a high accuracy, and a rotation force is transmitted to both the upper ends and the other ends of the pair of arcuate members 2*a*, 2*a* which are fixed to the rigid body in this way, so that, when the strip material is pressed, the movable die 2 rotates over a predetermined angle without being twisted.

In the bending apparatus, furthermore, in order to transmit a rotation force to both the upper ends and the other ends of the pair of arcuate members 2*a*, 2*a*, a rotation transmission mechanism which consists of gears connected to a single driving source (a pulse motor was used at the beginning of the development) is split into two paths so as to be connected to the upper ends and the other ends of the pair of arcuate members 2*a*, 2*a*. However, it was found that this configuration has the following drawback. The gears of the rotation transmission mechanism which is split into two paths must be arranged in a complex manner around the shaft body 3 comprising the stationary die 1. When there arises the necessity of removing the shaft body 3, therefore, the gears constituting the rotation transmission mechanism, or the movable die 2 must be removed before the removal of the shaft body 3. Hence, many hours of labor and a long time for the removal of the shaft body 3 are required. Moreover, irrationality was found that, when the shaft body 3 is once removed, the user is compelled to conduct difficult work such as the adjustment of the parallelism of the pressing die portions 21, 21 of the movable die 2, during the process of reassembling the shaft body.

The opening width of the slit 11 of the stationary die 1 has a size corresponding to the thickness of a strip material which is to be bent, and another stationary die 1 having a different opening width is required to be used for a strip material of a different thickness. In the bending apparatus according to the present invention, however, there is no way as described above but to compel the user to conduct difficult work such as the operation of removing and assembling the movable die 2, the gears, and the shaft body 3 comprising the stationary die 1. When a strip material of a different thickness is to be bent, therefore, it was impossible to conduct a simple and economic method wherein only the existing shaft body 3 is removed and it is replaced with another shaft body comprising the stationary die 1 having the slit 11 of an opening width which corresponds to the thickness of the strip material.

Best Mode for Carrying Out the Invention

Figure 1:
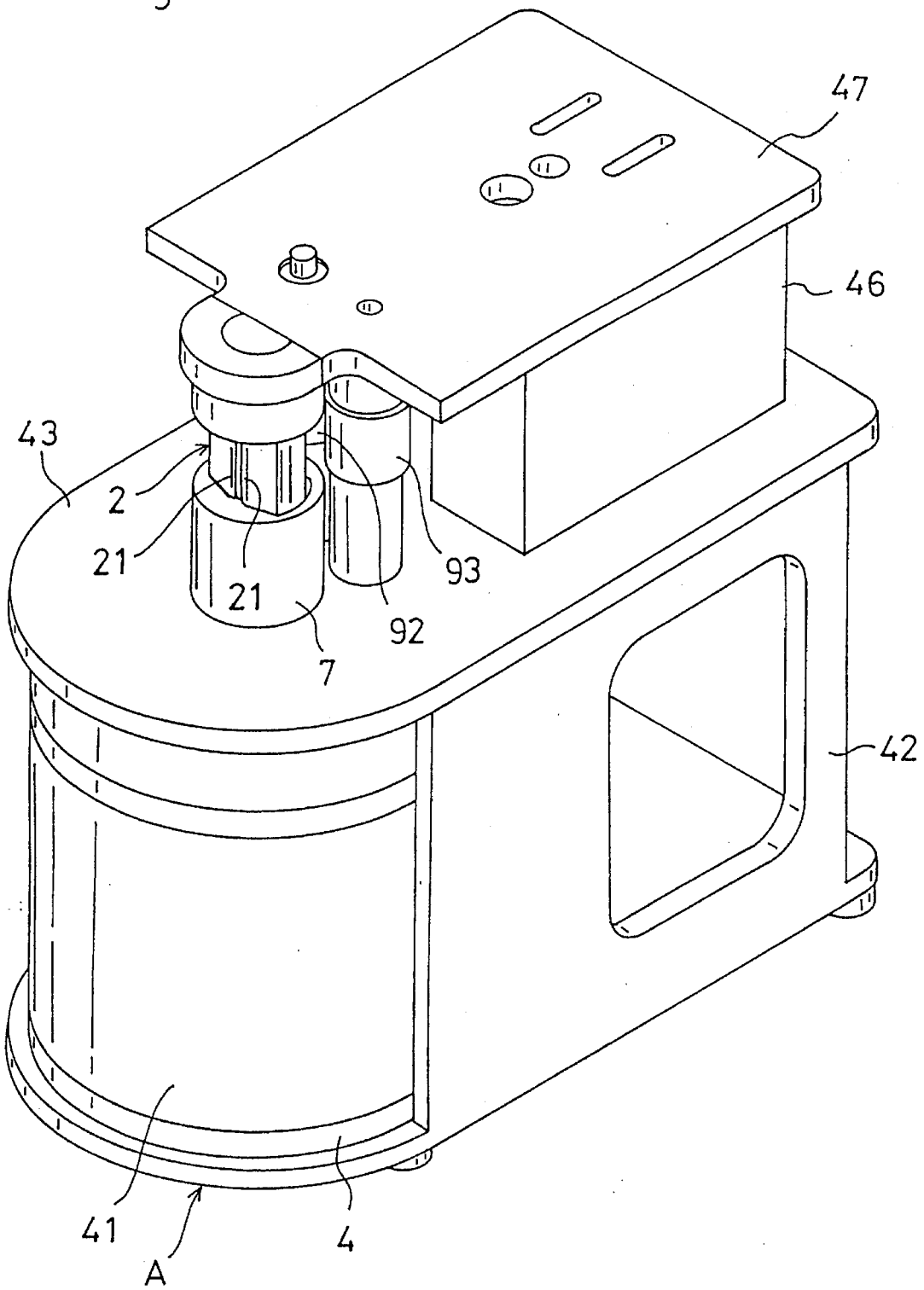
FIG. 1 is a view schematically showing the exterior of a bending apparatus of an embodiment of the invention.
Figure 2:
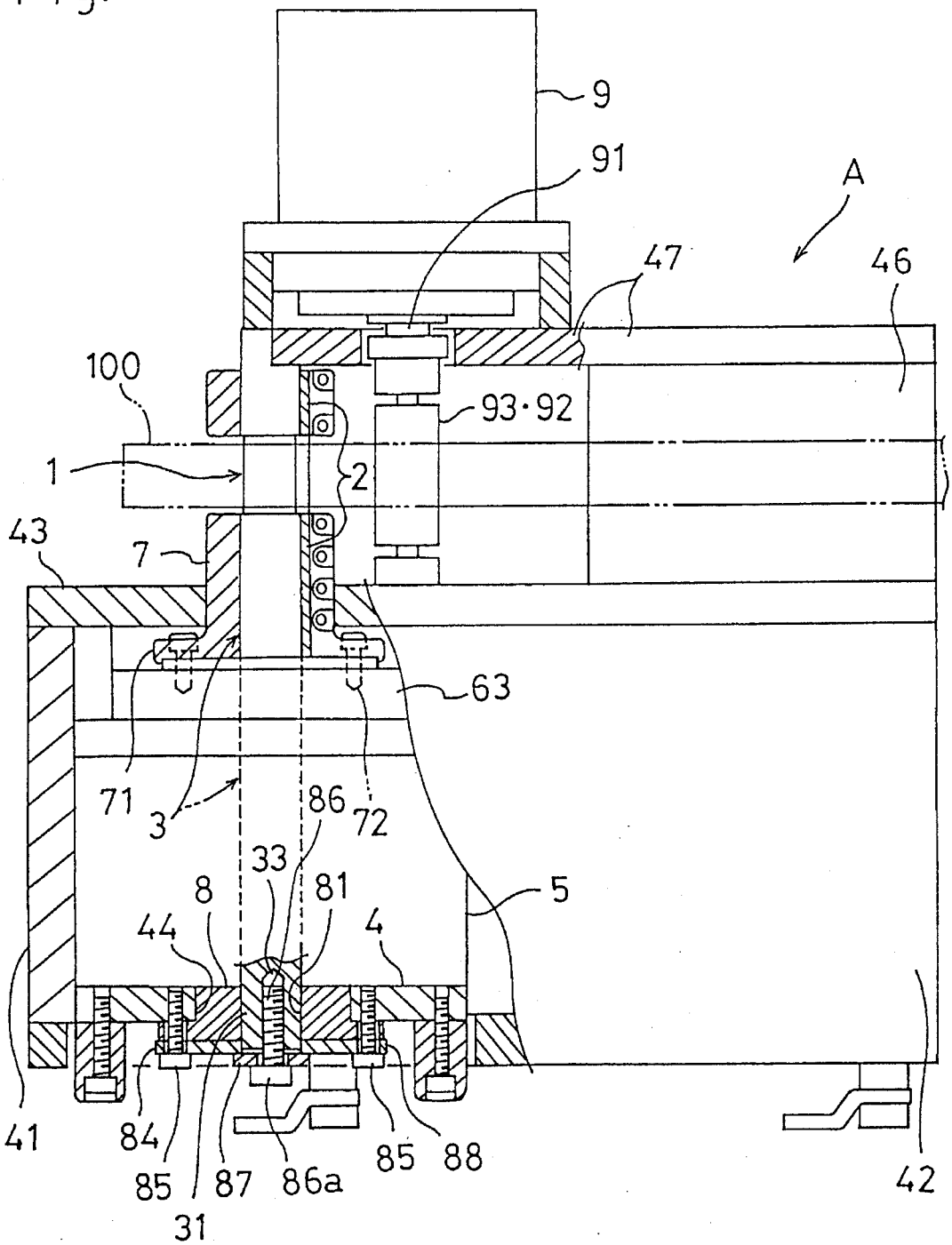
FIG. 2 is a partially fragmentary side view of the bending apparatus.
Figure 4:
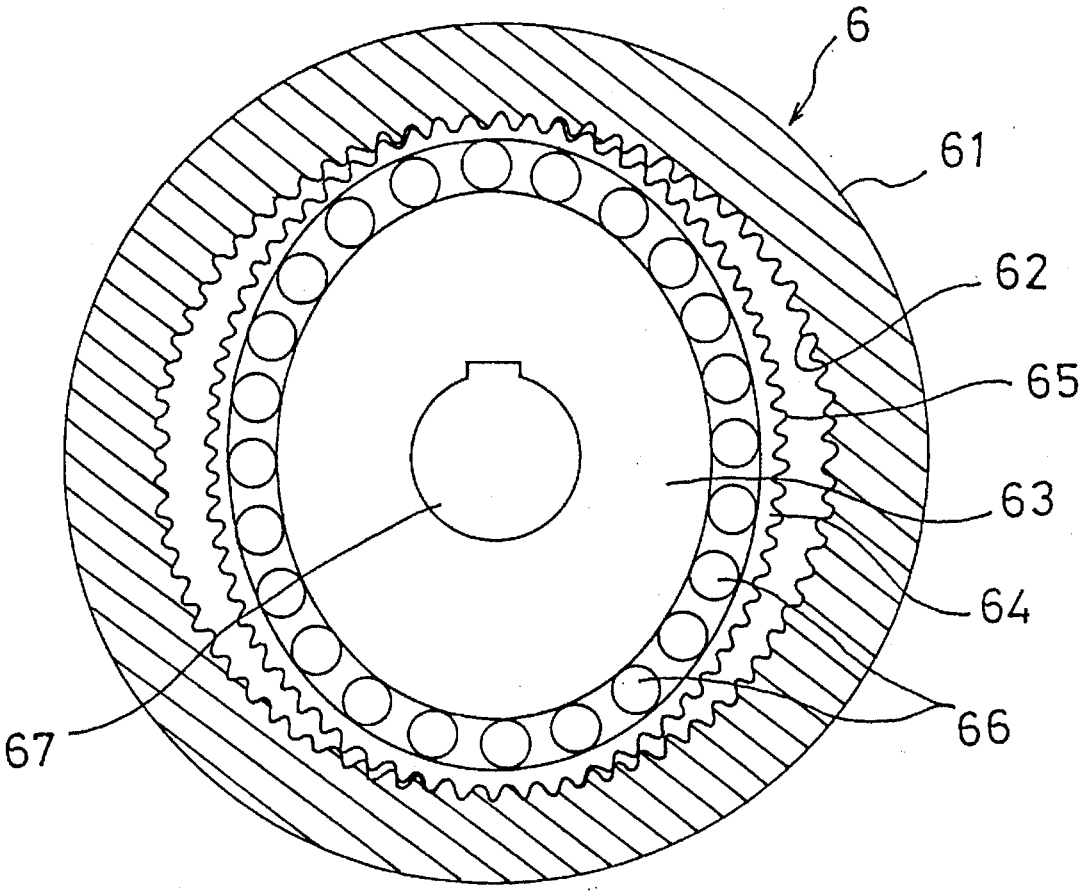
FIG. 4 is a view illustrating a reduction mechanism.

In a bending apparatus A shown in FIGS. 1 and 2, 4 designates a machine base, a front housing 41 and a side housing 42 are attached to the machine base 4, and an upper plate 43 is attached to the housings 41, 42. An electric motor 5 functioning as a driving source for a movable die 2 which will be described later is disposed in the front portion of the machine base 4.

A servomotor is used as the electric motor 5. The servomotor used as the electric motor 5 comprises a hole (not shown) which is concentric with the axis and vertically passed therethrough. The movable die 2 is connected to the rotor (not shown) of the electric motor 5 through a reduction mechanism 6 having a configuration which is illustratively shown in FIG. 4. Namely, the reduction mechanism 6 of FIG. 4 has a fundamental configuration wherein internal teeth 62 formed on an input rotor 61 engage with a part of external teeth 65 of a flexible pipe 64 which is fitted outward onto an elliptical output rotor 63 through a number of balls 66 and deformed into an elliptical shape. The rotor of the electric motor 5 is connected to the input rotor 61, and the movable die 2 is connected to the output rotor 63. A hole 67 which communicates with the above-mentioned hole of the electric motor 5 is formed at the center of the output rotor 63.

Figure 5:
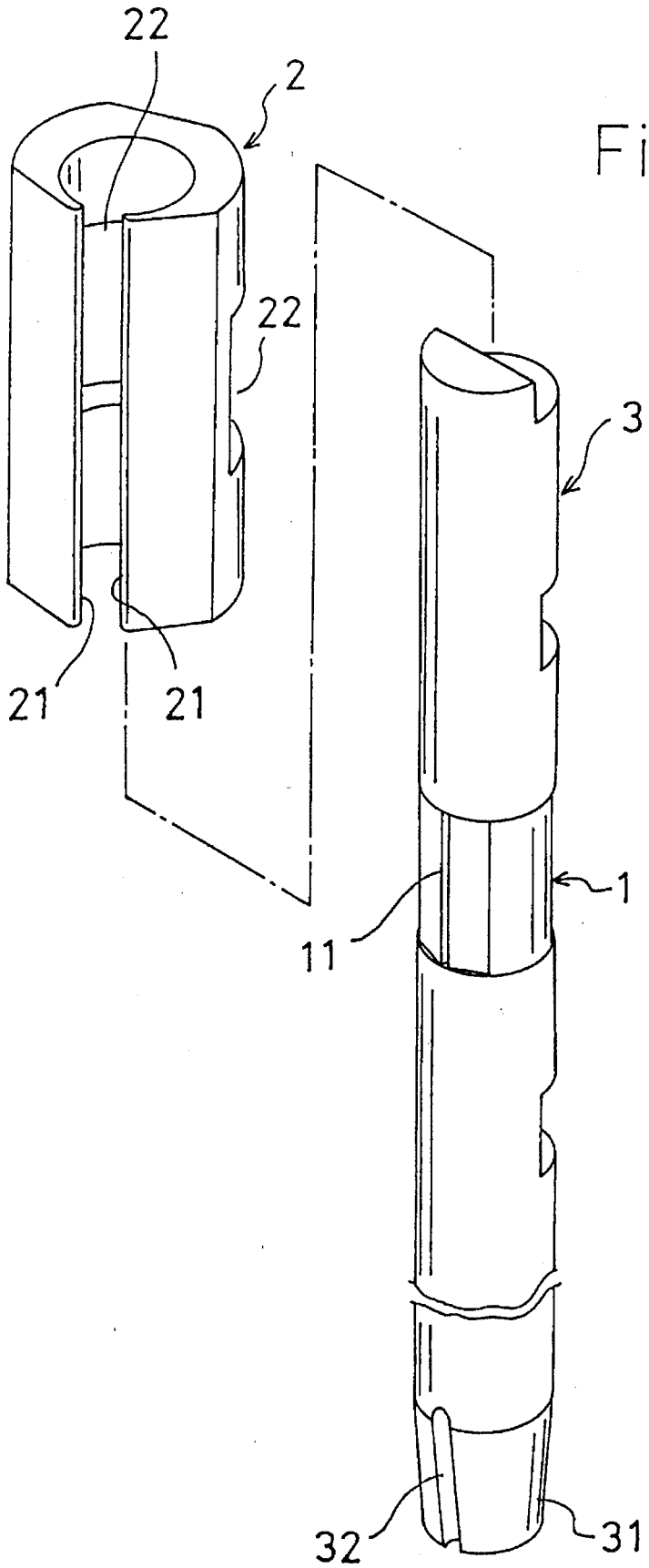
FIG. 5 is an exploded perspective view showing a shaft body comprising a stationary die, and a movable die.
Figure 6:
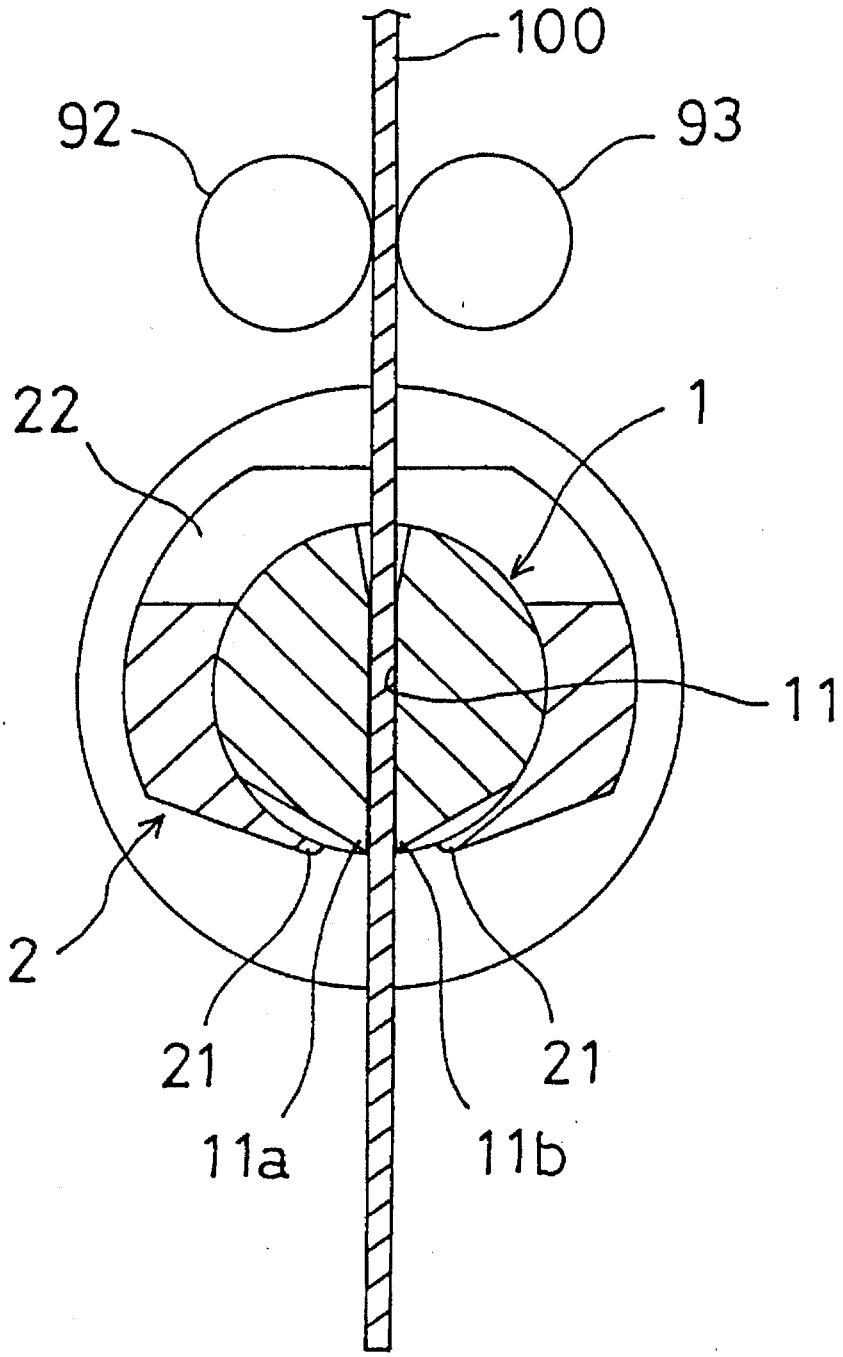
FIG. 6 is a view illustrating the function under the nonoperation state.
Figure 7:
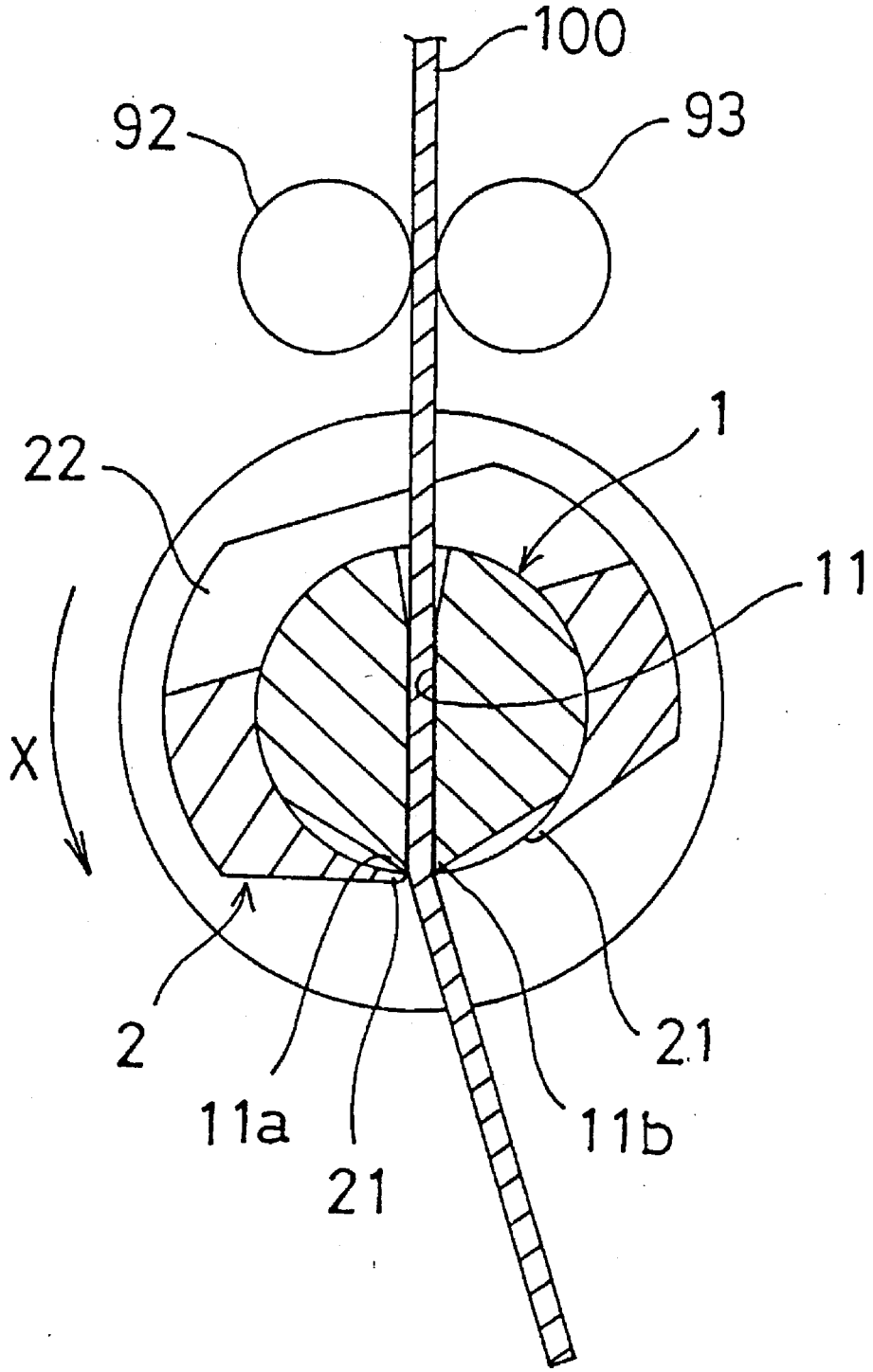
FIG. 7 is a view illustrating the function under the operation state.

As shown in FIG. 5, the stationary die 1 is integrated with a middle portion in the axial direction of a shaft body 3 which portion is close to the upper end of the shaft body. As shown in FIGS. 6 and 7, the stationary die 1 is provided with a slit 11 of an opening width which corresponds to the thickness of a strip material 100. A downward taper portion 31 is disposed at the lower end of the shaft body 3, and a key way 32 is formed on the downward taper portion 31. On the other hand, the movable die 2 comprises at a predetermined position along the circumferential direction a pair of pressing die portions 21, 21 which oppose each other in the circumferential direction, and is formed into a cylindrical shape having an opening 22 for introducing the strip material 100 at a position opposite to the pressing die portions 21, 21.

As shown in FIG. 2, a one-split mounting member 7 is clamped and fixed to the lower end of the movable die 2. A flange 71 of the mounting member 7 is concentrically fixed by using mounting screws 72 to the output rotor 63 of the reduction mechanism 6.

Figure 3:
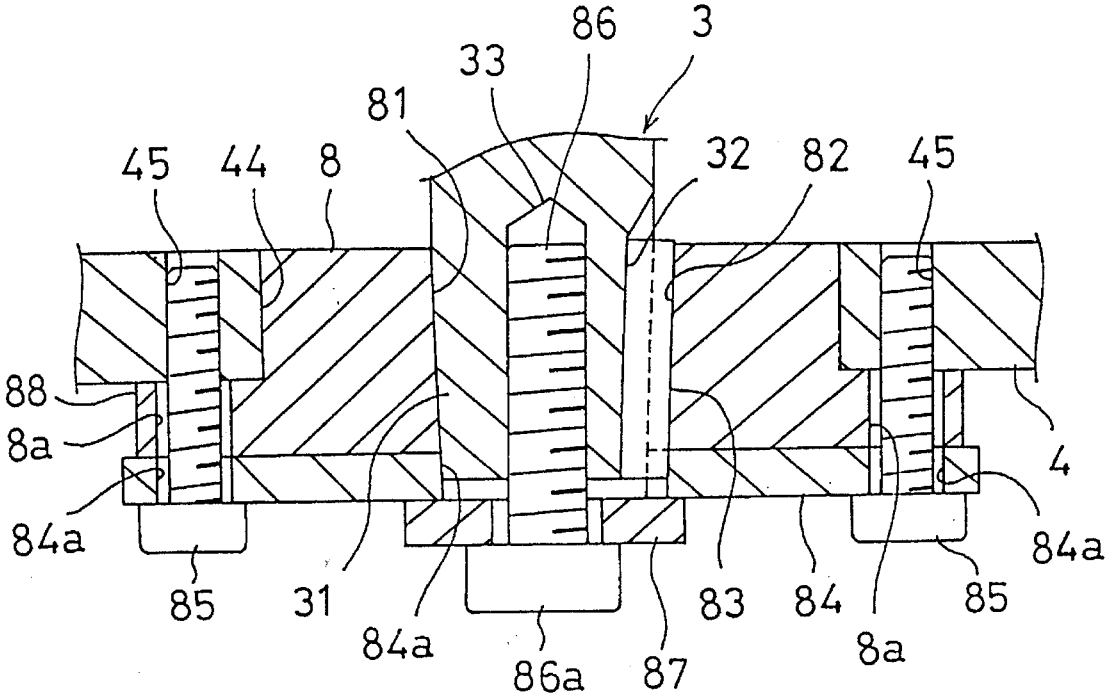
FIG. 3 is an enlarged section view showing the main portion of FIG. 2.

On the other hand, the downward taper portion 31 of the lower end of the shaft body 3 is fitted into an upward spread shaped mounting hole 81 formed in the mounting member 8. In the fitting portion, as shown in FIG. 3, a key 83 is fittingly attached to the key way 32 of the downward taper portion 31 and a key way 82 disposed on the mounting hole 81. A spacer 84 is superposed on the lower face of the mounting member 8, and a washer 87 is superposed on the lower face at a hole 84*a* of the spacer 84. A clamping bolt 86 passed through the washer 87 is screwed into a tapped hole 33 formed at the lower end of the shaft body 3. Under the state where the head 86*a* of the clamping bolt 86 is superposed on the washer 87, the downward taper portion 31 of the shaft body 3 is clamped and fixed to the upward spread shaped mounting hole 81 of the mounting member 8.

The mounting member 8 comprises a mounting flange 88. The shaft body 3 attached to the mounting member 8 is passed from the lower side of the machine base 4 and through an opening 44 opened in the machine base 4, and through the hole (not shown) of the electric motor 5, the hole 67 of the reduction mechanism 6, and the interior of the movable die 2. The mounting member 8 is fitted into the opening 44 of the machine base 4, and the mounting flange 88 of the mounting member 8 is superposed on the lower face of the machine base 4. The mounting member 8 is fixed to the machine base 4 by screwing mounting bolts 85 into tapped holes 45 in the side of the machine base 4 from the lower side, the mounting bolts 85 being passed through bolt-passing holes 8*a* of the mounting flange 88 and the bolt-passing holes 84*a* of the spacer 84 which is superposed on the lower face of the mounting member 8.

Next, a fitting plate 47 is attached to the upper plate 43 through a supporting body 46. An electric motor 9 is disposed on the fitting plate 47 as shown in FIG. 2. Either of feed rollers 92, 93 is interlocked with the rotating shaft 91 of the electric motor 9 (see FIGS. 6 and 7).

In the configuration above, preferably, the slit 11 of the stationary die 1 and the pair of pressing die portions 21 of the movable die 2 are accurately positioned under the nonoperating state shown in FIG. 6. With respect to this point, in the bending apparatus A, since the stationary die 1 is integrated with the shaft body 3, the downward taper portion 31 of the shaft body 3 is fitted into the upward spread shaped mounting hole 81 of the mounting member 8 so that the shaft body 3 is erected in a direction perpendicular to the mounting member 8 and centered, and the shaft body 3 is accurately positioned by the key 83 in the circumferential direction, the slit 11 of the stationary die 1 and the pair of pressing die portions 21 of the movable die 2 can be positioned with high preciseness and accuracy and without requiring special adjusting work.

FIG. 6 shows the nonoperating state of the movable die 2 with respect to the stationary die 1 during bending. As shown in FIG. 2, the strip material 100 is passed between the upper plate 43 and the fitting plate 47 to be supplied between feed rollers 92, 93 from behind. Intermittent rotation of the feed rollers 92, 93 owing to the driving of the electric motor 9 causes the strip material 100 to be intermittently fed out forward through the slit 11 of the stationary die 1. The movable die 2 is rotated by a predetermined amount in the forward or reverse direction when the feed of the strip material 100 is halted. FIG. 7 shows a state where the movable die 2 is rotated by the predetermined amount in the forward direction X. When the movable die 2 is rotated in the forward direction by the predetermined amount as shown in the figure, the strip material 100 is pressed by the left pressing die portion 21 of the movable die 2 against a right outlet corner 11*b* of the slit 11, to be bent in the rightward direction. Although not shown, when the movable die 2 is rotated from the nonoperating state in the reverse direction by the predetermined amount, the strip material 100 is pressed by the right pressing die portion 21 of the movable die 2 against a left outlet corner 11*a* of the slit 11, to be bent in the leftward direction. The bend angle of the strip material 100 corresponds to the rotation angle of the movable die 2.

In the bending apparatus A described above, when, in order to conduct the process of bending a strip material 100 of a different thickness, the existing shaft body 3 is to be replaced with another shaft body 3 comprising a stationary die 3 having a slit 11 of a different opening width, the following occurs. The plural (for example, six) mounting bolts 85 by which the mounting member 8 is fixed to the machine base 4 are removed. Thereafter, the mounting member 8, the spacer 84, and the shaft body 3 are pulled out to the lower side of the machine base 4 to be removed. Then the shaft body 3 for replacement to which the mounting member 8, the spacer 84, etc. are attached is passed through the opening 44 of the machine base 4 from the lower side of the machine base 4, and then through the hole (not shown) of the electric motor 5, the hole 67 of the reduction mechanism 6, and the interior of the movable die 2. The mounting member 8 is fixed to the machine base 4 by using the mounting bolts 85. The mounting member 8, the spacer 84, etc. may be reused to be attached to the shaft body 3 for replacement. The work of replacing the shaft body 3 is one which the user can easily conduct. For this work, it is not necessary to again adjust the parallelism of the pressing die portions 21, 21 of the movable die 2.

The reason why the user can also easily replace the shaft body 3 integrally comprising the stationary die 1 as described above is that the movable die 2 is formed into a cylindrical shape so that the necessity of adjusting the parallelism of the pressing die portions 21, 21 is completely eliminated, and bending is allowed to be conducted without twisting the movable die 2 by transmitting the transmission of the rotation force against the movable die 2 only to one end of the movable die 2, so that the rotation of the electric motor 5 is transmitted only to the one end of the movable die 2 through the rotation transmission mechanism formed by the reduction mechanism 6.

As described above, in the apparatus for bending a strip material according to the present invention, twisting of a movable die during a bending process is prevented from occurring by forming the movable die into a cylindrical shape, and rotation is transmitted to the movable die through only its one end. Consequently, the replacement of a stationary die integrated with a shaft body can easily be conducted without any accompanying difficult work such as adjustment of the parallelism of the pressing die portions of the movable die, and the disassemble of the gears. Therefore, the user can also easily replace the stationary die. The apparatus for bending a strip material according to the present invention can be applied not only to a process of bending a band blade, but also to a process of bending a strip material of another kind in a similar manner.

We claim:

1. An apparatus for bending a strip material, comprising:

a stationary die having a slit through which a strip material is passed, said slit defining a pair of spaced apart outlet corners and said stationary die being disposed on a shaft body;

a cylindrically shaped movable die which is moved a predetermined amount when feeding of the strip material passed through said slit of said stationary die is halted, the strip material passed through said slit of said stationary die being pressed by said movable die against an outlet corner of said slit, whereby the strip material is bent by a fixed angle; and a rotation transmission mechanism connected to said movable die for transmitting a rotation force to said movable die to move said movable die in a forward or reverse direction relative to said stationary die, wherein said movable die includes at a predetermined position along its circumferential direction a pair of pressing die portions which oppose each other in the circumferential direction, and an opening for introducing the strip material at a position opposite to said pressing die portions, said cylindrical movable die is rotatably fitted about said stationary die, an opening between said pair of pressing die portions corresponding to an outlet of said slit of said stationary die so that the strip material passed through said outlet of said slit of said stationary die is passed between said pair of pressing die portions, said opening for introducing the strip material corresponding to an inlet of said slit of said stationary die so that the strip material is guided to said inlet of said slit of said stationary die.

2. An apparatus for bending a strip material according to claim 1, further comprising:

a machine base;

a mounting member; and a plurality of keys, wherein a lower end of said shaft body is fixed to said machine base through said mounting member, a downward taper portion extending downwardly toward said machine base is disposed at the lower end of said shaft body, said downward taper portion is fitted into a mounting hole which is opened in said mounting member and which has an upward spread shape extending upwardly from said mounting member, and wherein each key is fittingly attached to a respective key way which is formed in said downward taper portion and said mounting hole.

3. An apparatus for bending a strip material according to claim 2, further comprising:

a spacer defining a hole; and a clamping bolt, wherein the lower end of said shaft body defines a tapped hole, and wherein said spacer is superposed on a lower face of said mounting member, and said downward taper portion of said shaft body is clamped and fixed to said upward spread shaped mounting hole of said mounting member by said clamping bolt which is screwed through the hole of said spacer into said tapped hole.

4. An apparatus for bending a strip material according to claim 3, further comprising:

a plurality of mounting bolts, wherein said machine base defines an opening, said mounting member comprises a mounting flange, and said mounting flange is fixed to said machine base by said mounting bolts under a state where said mounting member is fitted into said opening formed in said machine base.

5. An apparatus for bending a strip material according to claim 4, wherein said machine base includes a lower face and defines tapped holes, and said mounting flange defines bolt-passing holes, and wherein said mounting flange of said mounting member is superposed on the lower face of said machine base, and said mounting bolts are screwed from the lower side into the tapped holes disposed in said machine base, through the bolt-passing holes disposed in said mounting flange.

6. An apparatus for bending a strip material according to claim 3, further comprising:

a washer, wherein said clamping bolt defines a head and said spacer defines a lower space, wherein said washer is superposed on the lower face of said spacer, and said clamping bolt is passed through said washer, and wherein the head of said clamping bolt is superposed on said washer.

7. An apparatus for bending a strip material according to claim 4, further comprising:

a washer, wherein said clamping bolt defines a head and said spacer defines a lower space, wherein said washer is superposed on the lower face of said spacer, and said clamping bolt is passed through said washer, and wherein the head of said clamping bolt is superposed on said washer.

8. An apparatus for bending a strip material according to claim 5, further comprising:

a washer, wherein said clamping bolt defines a head and said spacer defines a lower space, wherein said washer is superposed on the lower face of said spacer, and said clamping bolt is passed through said washer, and wherein the head of said clamping bolt is superposed on said washer.

* * * * *